US009920473B2

(12) United States Patent
Long et al.

(10) Patent No.: US 9,920,473 B2
(45) Date of Patent: Mar. 20, 2018

(54) METHOD FOR COLOUR-FIXING PROCESSING OF TEXTILE AND DEVICE THEREFOR

(71) Applicant: Soochow University, Suzhou, Jiangsu (CN)

(72) Inventors: Jiajie Long, Suzhou (CN); Chuanglong Cui, Suzhou (CN); Hongmei Xu, Suzhou (CN); Xiaochen Wei, Suzhou (CN); Feng Chen, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 156 days.

(21) Appl. No.: 14/916,031

(22) PCT Filed: Sep. 3, 2013

(86) PCT No.: PCT/CN2013/082834

§ 371 (c)(1),
(2) Date: Mar. 2, 2016

(87) PCT Pub. No.: WO2015/032022

PCT Pub. Date: Mar. 12, 2015

(65) Prior Publication Data

US 2016/0194825 A1 Jul. 7, 2016

(51) Int. Cl.

| | |
|---|---|
| ***D06P 5/10*** | (2006.01) |
| ***D06P 5/02*** | (2006.01) |
| ***D06B 5/12*** | (2006.01) |
| ***D06P 1/94*** | (2006.01) |
| ***D06M 23/00*** | (2006.01) |
| ***D06P 1/655*** | (2006.01) |
| ***D06P 1/673*** | (2006.01) |
| *D06M 23/10* | (2006.01) |

(52) U.S. Cl.

CPC ..... *D06P 5/10* (2013.01); *D06B 5/12* (2013.01); *D06P 1/655* (2013.01); *D06P 1/67333* (2013.01); *D06P 1/94* (2013.01); *D06P 5/02* (2013.01); *D06M 23/105* (2013.01)

(58) Field of Classification Search

CPC ..... D06P 5/02; D06P 5/10; D06P 1/94; D06P 1/655; D06P 1/67333; D06B 5/12; D06M 23/105

See application file for complete search history.

(56) References Cited

FOREIGN PATENT DOCUMENTS

| | | | |
|---|---|---|---|
| CN | 101021038 | A | 8/2007 |
| CN | 201033850 | A | 3/2008 |
| CN | 102296469 | A | 12/2011 |
| CN | 102392367 | A | 3/2012 |
| JP | 2005273098 | A | 10/2005 |

OTHER PUBLICATIONS

Derwent 2008-A80213, 2009.*

* cited by examiner

*Primary Examiner* — Amina S Khan
(74) *Attorney, Agent, or Firm* — SZDC Law P.C.

(57) ABSTRACT

A device for color-fixing processing on textiles includes a supercritical carbon dioxide fluid unit, a fixing liquid storage tank (2) and a fixing reactor (9). The fixing liquid storage tank (2) is below the fixing reactor (9) and sealed connected by a connecting device (6). The fixing liquid storage tank (2) has a cylindrical cavity in which a fluid distributor (4) is mounted. The fluid distributor (4) is composed of several interconnected pipes which bend down with the nozzles downward, and one of the pipes is used as circulated fluid inlet (1) connected with the supercritical carbon dioxide fluid unit, and the rest of the pipes are used as circulated fluid outlets.

6 Claims, 1 Drawing Sheet

METHOD FOR COLOUR-FIXING PROCESSING OF TEXTILE AND DEVICE THEREFOR

This application is a PCT National Stage Application of PCT/CN2013/082834, filed on Sep. 3, 2013, which is incorporated by reference for all purposes as if fully set forth herein.

TECHNICAL FIELD

The present invention relates to a device and the method for colour-fixing processing of textile. More particularly, it relates to a device and a process of phase transfer catalytic fixation with disperse reactive dyes on textiles, especially for the natural-fibre textiles in supercritical carbon dioxide, belonging to the field of textile dyeing and finishing technology.

BACKGROUND ART

The technology of dyeing in supercritical carbon dioxide fluid has significant characteristics of clean production, such as ecology, environmental protection, energy conservation and emissions reduction, and it is of great importance for changing present situation of high pollution and energy-intensive in the traditional textile printing and dyeing industry. At present, the hydrophobic synthetic fibres such as polyester can obtain a good dyeing effect with disperse dyes in supercritical carbon dioxide fluid. The technology has gradually developed from small sample studied in the laboratory to application of pilot trials, and some commercial samples or products have come onto market (referring to the publications: Pilot trials of supercritical $CO_2$ dyeing of polyester fabric [J]. Dyeing and finishing, 2013 (10):49-53; DyeCoo Textile System B.V., Nike, Inc. announces strategic partnership to scale waterless dyeing technology. Available from: www.dyecoo.com/pdfs/press-release-nike.pdf, 2012).

However, it's much more complex and difficult to dye and fix with the hydrophilic natural fibers in supercritical carbon dioxide fluid. At present, it is generally believed that it's one of the feasible and effective ways to realize natural-fibre textiles dyeing in supercritical carbon dioxide fluid with disperse reactive dyes which are structure-optimized (referring to the publications: Dyeing of cotton fabric with a reactive disperse dye in supercritical carbon dioxide, The journal of supercritical fluids, 2012, 69: 13-20; Solubility of a reactive disperse dye in supercritical carbon dioxide, Coloration technology, 2012, 128: 127-132). One of the difficulties is how to achieve the reaction of dyes and fibres in the weak acidic medium of supercritical carbon dioxide fluid, and reduce the processing conditions while maintaining high fixation efficiency.

Therefor, the research of unit device and process about textile fixing in supercritical carbon dioxide fluid, especially for natural-fibre textiles, has very important significance and a broad market prospect as it facilitates the process of textiles anhydrous dyeing and fixing, and achieves the clean production of enterprises of textile printing and dyeing thoroughly.

CONTENT OF THE INVENTION

The purpose of the present invention is to provide a device and a method for colour-fixing processing, especially a device and a method of phase transfer catalytic fixation with the natural-fibre textiles dyed by disperse reactive dyes in supercritical carbon dioxide fluid.

The technical solution of the present invention includes: A device for colour-fixing processing on textiles, comprising a system of supercritical carbon dioxide fluid, a fixing liquid storage tank and a fixing reactor, said fixing liquid storage tank is below said fixing reactor and sealed connected by a connecting device, said fixing liquid storage tank has a cylindrical cavity in which a fluid distributor is mounted, said fluid distributor is composed of several interconnected pipes which bending down with the nozzles downward, and one of the pipes is used as circulated fluid inlet connected with said supercritical carbon dioxide fluid system, and the rest pipes are used as circulated fluid outlets, said fixing reactor has a cylindrical cavity, with a circulated fluid outlet on the top and connected with said supercritical carbon dioxide fluid system; a porous filter is installed at the bottom of the reactor, and the lower part of a fluid diversion cover is horn shaped, covering at the top of the porous filter, and the top port of the fluid diversion cover is connected with the opposed port of textile winding shaft, said textile winding shaft is a cylindrical hollow shaft, whose top port is closed and holes are set on the cylinder.

In the present invention, the material of said shaft textile winding or the material of the internal and external surface of said shaft textile winding is teflon or non-thermal conductivity material. Said porous filter has a shape of a plate of single layer or multi-layer, distributed with micro-porous with mesh number of 50~2000.

Using the device described above, the present invention provides a process for colour-fixing processing on textiles, it comprises the following steps:

a. evenly wrapping textiles which have been dyed in supercritical carbon dioxide fluid around the textile winding shaft in loose state, with a layer of seamless mesh cloth set on the outermost layer, and placing said textile winding shaft into the fixing reactor whose lower port is connected with the top port of the fluid diversion cover;
b. adding fixing mixture containing alkaline fixing accelerant and phase transfer catalyst in the fixing liquid storage tank, and seal connecting the fixing liquid storage tank with the fixing reactor;
c. connecting the circulated fluid outlet of the fixing liquid storage tank and the circulated fluid inlet of the fluid distributor with the system of supercritical carbon dioxide fluid respectively, opening the system of supercritical carbon dioxide fluid, so that the circulated fluid comes into the fixing mixture through the fluid distributor in the fixing liquid storage tank and gets in touch with the mixture sufficiently; with the help of phase transfer catalyst, alkaline accelerant enters into the hydrophobic fluid phase, and reacts with the functional groups on fibres, achieving the process of phase transfer catalytic fixation on textiles.

In present invention, said alkaline fixing accelerants are selected from sodium hydroxide, sodium carbonate and sodium phosphate, or the substances that can produce hydroxyl by hydrolysis or thermal decomposition in the environment with a small amount of water. Said phase transfer catalyst is selected from perfluoroalkylsulfonyl quaternary ammonium salt, or quaternary ammonium salt with fat chain containing $C_{12}$~$C_{18}$ or possessing aromatic base.

The principle of present invention is that: connecting the lower port of the fixing reactor with the fixing liquid storage tank by a connecting device, and there is a tubular fluid distributor whose middle pipe is connected with the circulated fluid inlet at the lower port. Meanwhile, a porous filter and a fluid diversion cover are installed at the lower port of the fixing reactor, the circulated fluid outlet is installed on the top port, and the textile winding shaft is inside the reactor. The treatment system of the present device can be connected with external devices through the circulated fluid inlet and outlet. When the supercritical carbon dioxide fluid in the treatment system circulates, the fluid would pass through the tubular fluid distributor, and contact with fixing alkaline accelerant and phase transfer catalyst in the fixing liquid storage tank sufficiently, and with the help of phase transfer catalyst, fixing alkaline accelerant is transported to hydrophobic fluid phase, accompanying with a reaction with functional groups on fibres. As a result, the reactivity of functional groups on fibres with dyes and the fixation efficiency are improved.

With the above technical solution, compared with prior arts, the present invention has achieved breakthrough in the aspects of dyeing and fixing on textiles in supercritical carbon dioxide, especially for the natural-fibre textiles, and the fixation effect of the products are remarkable, besides, it has the advantage of practicability. Meanwhile, the present invention also has the characteristics of simplification of the device and the process, convenient operations, and it has a wide market prospect.

Figure 1:
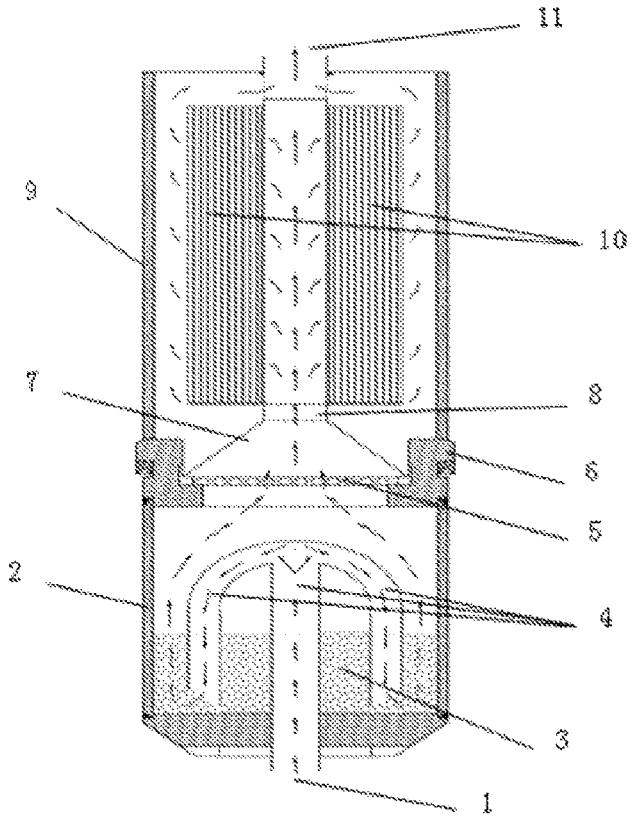
FIG. 1 is the schematic of the device for colour-fixing processing on textiles in supercritical carbon dioxide fluid provided by this invention.

In the FIG. 1: 1. the circulated fluid inlet; 2. the fixing liquid storage tank; 3. fixing mixture; 4. the fluid distributor; 5. the filter; 6. the connecting device; 7. the fluid diversion cover; 8. the textile winding shaft; 9. the fixing reactor; 10. textiles winded; 11. the circulated fluid outlet.

DETAILED DESCRIPTION OF THE EMBODIMENTS

The present invention will be further described below with reference to drawings and embodiments.

Embodiment

Refer to FIG. 1, it is the schematic of the device of colour-fixing processing on textiles in supercritical carbon dioxide fluid provided in this embodiment. It consists of a fixing liquid storage tank, a fixing reactor and a supercritical carbon dioxide fluid treatment system possessing a circulation pump, the circulating pump is omitted in the figure.

The fixing liquid storage tank 2 has a cylindrical cavity, in which a fluid distributor 4 with tube shaped like the letter "E" turned 90 degree clockwise is mounted. The fluid distributor 4 is consist of three interconnected pipes which bending down, two of them are circulated fluid outlet, and pipe located in the center is the circulated fluid inlet 1, connecting with supercritical carbon dioxide fluid system through the lower port of the fixing liquid storage tank. The fixing liquid storage tank and a fixing reactor 9 are connected by connecting device as a whole. The fixing reactor has a cylindrical cavity, a filter 5 and a horn shaped fluid diversion cover 7 are installed at the bottom, and there is a circulated fluid outlet 11 on the top. In the fixing reactor, there is a textile winding shaft 8 which winding the textiles to be processed, and its lower port is opening, connecting with the fluid diversion cover; on the contrary, the top port is closed but opens a roller hole. The material of the shaft body or its internal and external surface is teflon or non-thermal conductivity material. The fixing liquid storage tank and the fixing reactor are connected to the system of supercritical carbon dioxide fluid through the circulated fluid inlet and outlet. When processing, fixing mixture 3 is added to the fixing liquid storage tank, the nozzle of circulated fluid outlet pipeline in fluid distributor is placed in the solution, and the textiles 10 to be processed in loose state are evenly wrapped around the shaft. In present example, the filter is single layer or multi-layer plate material distributed with micro-porous whose mesh number is 50~2000.

The processing operation includes the following steps:

Textiles to be processed are evenly wrapped around the textile winding shaft in loose state, with a layer of seamless mesh cloth set on the outermost layer; then place the shaft into the fixing reactor whose lower port is well connected with the top port of fluid diversion cover.

According to the predetermined requirements of fixation processing, add fixing mixture involving sensibly alkaline fixing accelerant and phase transfer catalyst into the fixing liquid storage tank. Alkaline fixing accelerants are sodium hydroxide, sodium carbonate and sodium phosphate, or the substances that can produce hydroxyl by hydrolysis or thermal decomposition in the feed water environment, and phase transfer catalyst is perfluoroalkylsulfonyl quaternary ammonium salt, or quaternary ammonium salt (FC-134) with fat chain containing $C_{12}$~$C_{18}$ or possessing aromatic base. Connect the fixing liquid storage tank with fixing reactor by connecting device so as to form a combined device.

Connect the combined device with the supercritical carbon dioxide fluid treatment system possessing a circulation pump through circulated fluid inlet and outlet, or place the combined device into the supercritical carbon dioxide fluid treatment system possessing a circulation pump, and then open the circulation pump or device in external connecting system according to the predetermined fixing process and parameters, making the circulated fluid pass through the tubular fluid distributor in the fixing liquid storage tank. Thereby, the circulated fluid contacts with fixing alkaline accelerant and phase transfer catalyst sufficiently, and with the help of phase transfer catalyst, fixing alkaline accelerant is transported to hydrophobic fluid phase, accompanying with a reaction with functional groups on fibres. As a result, the reactivity of functional groups on fibres and the fixation efficiency are improved, and finally it realizes the process of phase transfer catalytic fixation on textiles availably.

After completion of fixation with heat-pressure holding, the fluid stops circulating, and the pressure in the fixation system is released. Separate and recycle the fixing accelerant, phase transfer catalyst and fluid in the fixation circulatory system by an external separating and recycling system. Open the connecting device after releasing the pressure, and remove the textiles fixed.

Reclaim the residual fixing mixture in the fixing liquid storage tank, or add additional components for continued using.

Figure 2:
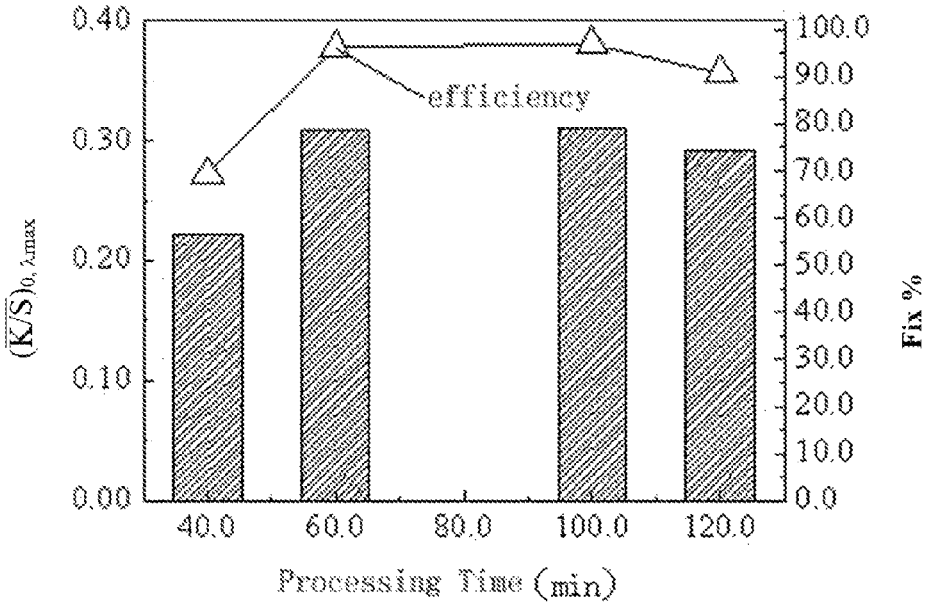
FIG. 2 is the chart about comparison of effect of fixation processing on textiles in different conditions provided by this invention.

Refers to FIG. 2, it is the result of different fixing times with a woven cotton fabric (102.0 g/m$^2$) in dry state dyed by disperse reactive red (containing an active group of ethenyl, 0.2% o.m.f). The concrete conditions are defined as system pressure of 12.0 MPa, temperature of 140° C., and mixture (the solid content of 10%; n($Na_2CO_3$):n((FC-134)=1:3) of fixation accelerant ($Na_2CO_3$) and phase transfer catalyst (FC-134) in fixing liquid storage tank of 16.50 g. In addition, the analysis and test of the apparent color depth value $(\overline{K/S})_{0,\lambda max}$ and fixation efficiency Fix (%) of cotton fabrics fixed by disperse reactive red in present instance refer to Chinese invention patent whose public number is CN102392367A named "the fixing method of disperse reactive dyes in low pressure carbon dioxide".

FIG. 2 indicates that, with the help of phase transfer catalyst, the fixing apparent color depth value $(\overline{K/S})_{0,\lambda max}$ and fixation efficiency of dry cotton fabrics fixed by disperse reactive red in supercritical carbon dioxide are enhanced effectively. Furthermore, the fixation effect of phase transfer catalysis is improved along with the extend processing time, and accompanies with the maximum fixation apparent color depth value $(\overline{K/S})_{0,\lambda max}$ and fixation efficiency at 0.308 and 96.4% respectively, as the fixing times range 60 min~100 min, showing an apparent effect of catalytic fixation.

The embodiment and method about textiles, particularly the natural-fibre textiles dyeing and fixing water-free in supercritical carbon dioxide provided by present invention have the characteristics of practicability, and improving the fixation efficiency of disperse reactive dyes on textiles, shortening the processing time, with simple equipment and process, convenient operation. Thus, it is of a wide application prospect.

What is claimed is:

1. A device for colour-fixing processing on textiles comprising a supercritical carbon dioxide fluid unit, a fixing liquid storage tank (2), and a fixing reactor (9), wherein said fixing liquid storage tank (2) is below said fixing reactor (9), sealed, and connected by a connecting device (6); said fixing liquid storage tank (2) has a cylindrical cavity in which a fluid distributor (4) is mounted; said fluid distributor (4) is composed of a plurality of interconnected pipes which bend down with the nozzles downward, and one of the pipes is used as circulated fluid inlet (1) connected with said supercritical carbon dioxide fluid unit, and the rest of the pipes are used as circulated fluid outlets; said fixing reactor (9) has a cylindrical cavity, with a circulated fluid outlet (11) on the top and connected with said supercritical carbon dioxide fluid unit; a porous filter (5) is installed at the bottom of the reactor (9); and the lower part of a fluid diversion cover (7) is horn shaped, covering the top of the porous filter (5), and the top port of the fluid diversion cover (7) is connected with the opposed port of a textile winding shaft (8), said textile winding shaft (8) is a cylindrical hollow shaft, whose top port is closed and holes are set on the cylinder.

2. The device for colour-fixing processing on textiles according to claim 1, wherein the material of said shaft textile winding (8) or the material of the internal and external surface of said shaft textile winding (8) is teflon or non-thermal conductivity material.

3. The device for colour-fixing processing on textiles according to claim 1, wherein said porous filter (5) has a shape of a plate of single layer or multi-layer, distributed with micro-porous with mesh number of 50~2000.

4. A process for colour-fixing processing on textiles comprising the following steps:

a0. providing a device for colour-fixing processing on textiles according to claim 1;

a. evenly wrapping textiles which have been dyed in supercritical carbon dioxide fluid around the textile winding shaft in loose state, with a layer of seamless mesh cloth set on the outermost layer, and placing said textile winding shaft into the fixing reactor whose lower port is connected with the top port of the fluid diversion cover;

b. adding fixing mixture containing alkaline fixing accelerant and phase transfer catalyst in the fixing liquid storage tank, and seal connecting the fixing liquid storage tank with the fixing reactor;

c. connecting the circulated fluid outlet of the fixing liquid storage tank and the circulated fluid inlet of the fluid distributor with the supercritical carbon dioxide fluid unit respectively, opening the supercritical carbon dioxide fluid unit, so that the circulated fluid comes into the fixing mixture through the fluid distributor in the fixing liquid storage tank and gets in touch with the mixture; with the help of phase transfer catalyst, alkaline accelerant enters into the hydrophobic fluid phase, and reacts with the functional groups on fibres, achieving the process of phase transfer catalytic fixation on textiles.

5. The process for colour-fixing processing on textiles according to claim 4, wherein said alkaline fixing accelerants are selected from sodium hydroxide, sodium carbonate and sodium phosphate.

6. The process for colour-fixing processing on textiles according to claim 4, wherein said phase transfer catalyst is selected from perfluoroalkylsulfonyl quaternary ammonium salt, or quaternary ammonium salt with fat chain containing $C_{12}$~$C_{18}$ or possessing aromatic base.

* * * * *